United States Patent [19]

Boardman et al.

[11] Patent Number: 4,875,356

[45] Date of Patent: Oct. 24, 1989

[54] MATERIAL FABRICATING MECHANISM

[75] Inventors: Peter W. Boardman, St. Catharines; Daniel G. McCombs, Welland, both of Canada

[73] Assignee: Deere & Company, Moline, Ill.

[21] Appl. No.: 235,132

[22] Filed: Aug. 23, 1988

[51] Int. Cl.[4] ..... B21D 5/04

[52] U.S. Cl. ..... 72/321; 72/319; 72/323

[58] Field of Search ..... 72/319–321, 72/316, 322, 312–314, 323

[56] References Cited

U.S. PATENT DOCUMENTS

| | | | |
|---|---|---|---|
| 2,217,378 | 10/1940 | Nilsby | 72/319 |
| 2,228,448 | 1/1941 | Fader, Jr. | 72/319 |
| 2,283,012 | 5/1942 | Nightingale | 72/319 |
| 2,394,193 | 2/1946 | McCabe | 72/321 |
| 3,662,584 | 5/1972 | Jones, Jr. et al. | 72/321 |
| 4,365,500 | 12/1982 | Klukow | 72/319 |

FOREIGN PATENT DOCUMENTS

| | | | |
|---|---|---|---|
| 52936 | 3/1986 | Japan | 72/320 |

OTHER PUBLICATIONS

Parker Hydra Power Rack & Pinion Actuators Brochure, Parker Fluidpower, Rotary Actuator Division, Wadsworth, Ohio.

*Primary Examiner*—Daniel C. Crane

[57] ABSTRACT

There is provided a bending mechanism for use in the fabrication of metal and other materials. The bending mechanism includes a clamping structure to secure the material to a supporting plate with the portion of the material to be bent projecting from the clamping structure. A bending plate is then brought into contact with the material and rotated about the edge of the supporting plate to bend the material to the desired angle. Multiple bending mechanisms can be utilized for longer and/or multiple bends of the material.

43 Claims, 6 Drawing Sheets

MATERIAL FABRICATING MECHANISM

FIELD OF THE INVENTION

The present invention relates to manufacturing equipment and, in particular, to a mechanism for bending metal and other materials. Specifically, the mechanism is designed to perform bending of metal in fabricating operations, and can be used in the fabrication of rotary mower housings.

DESCRIPTION OF THE RELATED ART

Metal bending as a fabrication step in manufacturing operations has traditionally been done with the use of hydraulic presses and dies. When a particular metal bend configuration is desired, a specific die is manufactured for that operation. The die is then placed on the bed of a hydraulic press, the metal inserted between the ram and die and bent to the desired configuration as the ram descends.

Not only are high force levels required to accomplish such metal bending operations, but dies also wear and deteriorate with use resulting in the angle of bend beginning to vary from that desired.

BRIEF SUMMARY OF THE INVENTION

To overcome the problems associated with the present method of metal bending, there is provided herein a mechanism for quickly bending metal to the desired angle with substantially lower forces than have traditionally been required in the hydraulic press and die operation.

Specifically, there is provided a mechanism for clamping the metal to be bent between two surfaces and, while holding the metal in that position, using a third surface to contact the metal projecting from the clamped surface and bend it about the edge of one clamping surface.

Through clamping the metal first and bending it about the edge of one clamped surface, coining, which occurs in traditional die impact bending is avoided. Accordingly, the metal is less weakened at the bend and is not compressed at the outside surface of the bend as it would be when struck between the hydraulic ram and die.

Through eliminating the use of dies, the down time and expense associated with die set up, die changes and die refurbishing are accordingly eliminated.

DETAILED DESCRIPTION OF THE INVENTION

Figure 2:
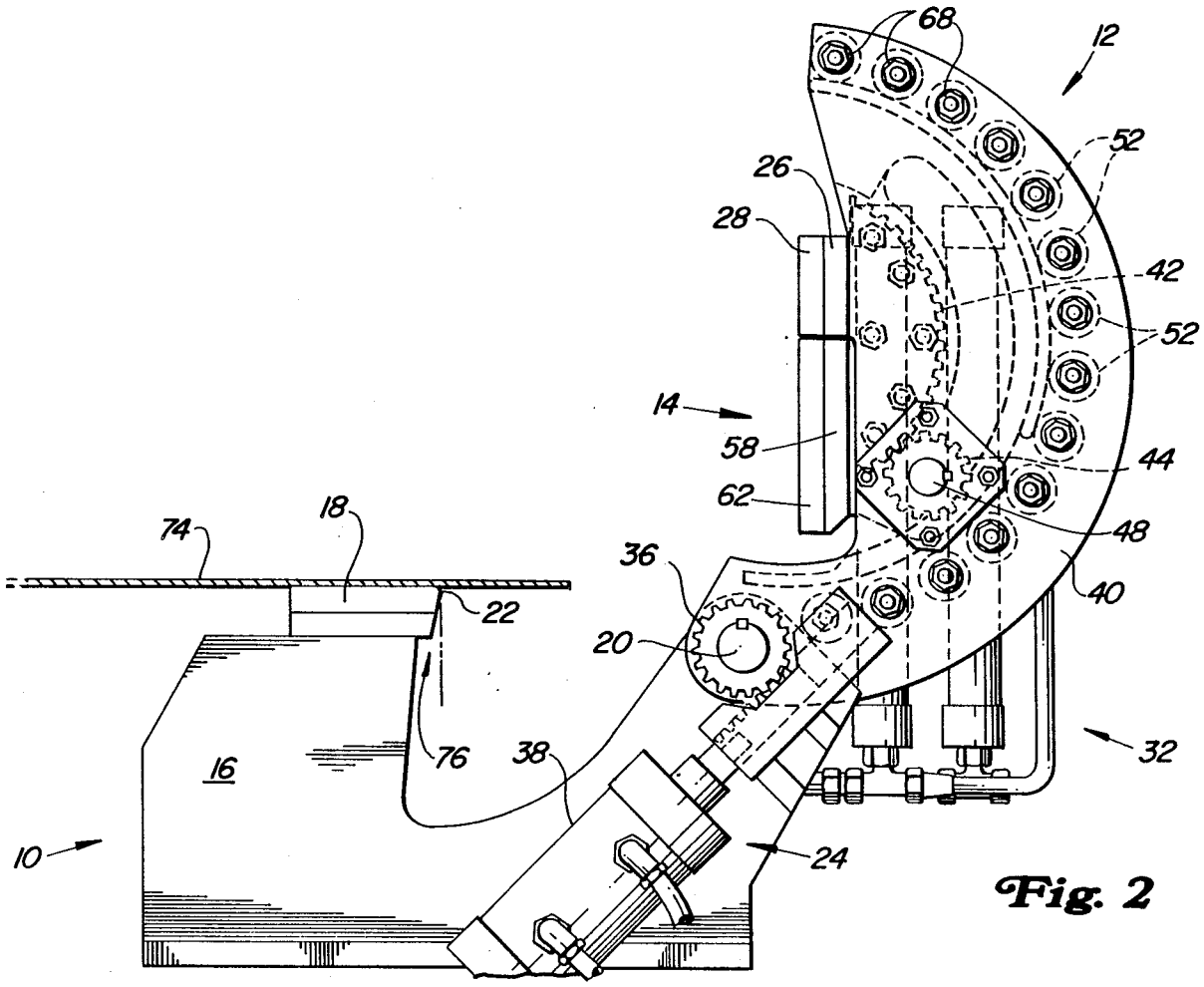
FIG. 2 is a side view of the present invention in its metal receiving position.
Figure 3:
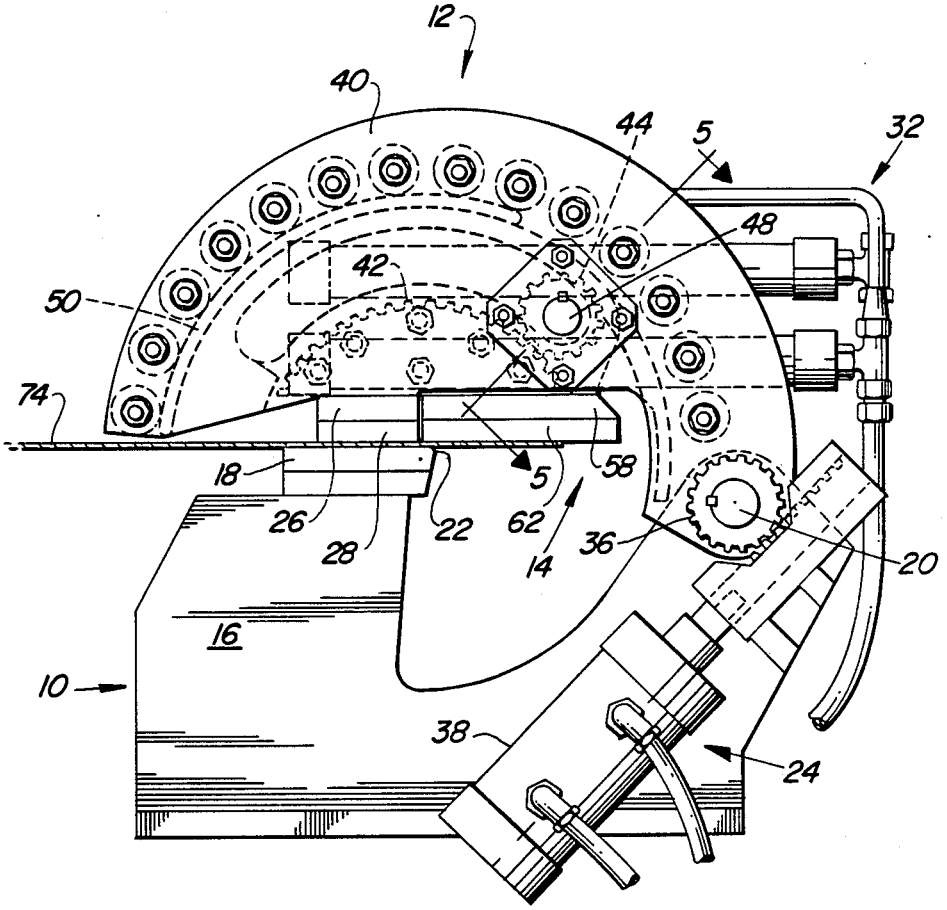
FIG. 3 is another side view of the present invention illustrating the invention in its metal clamping position.
Figure 4:
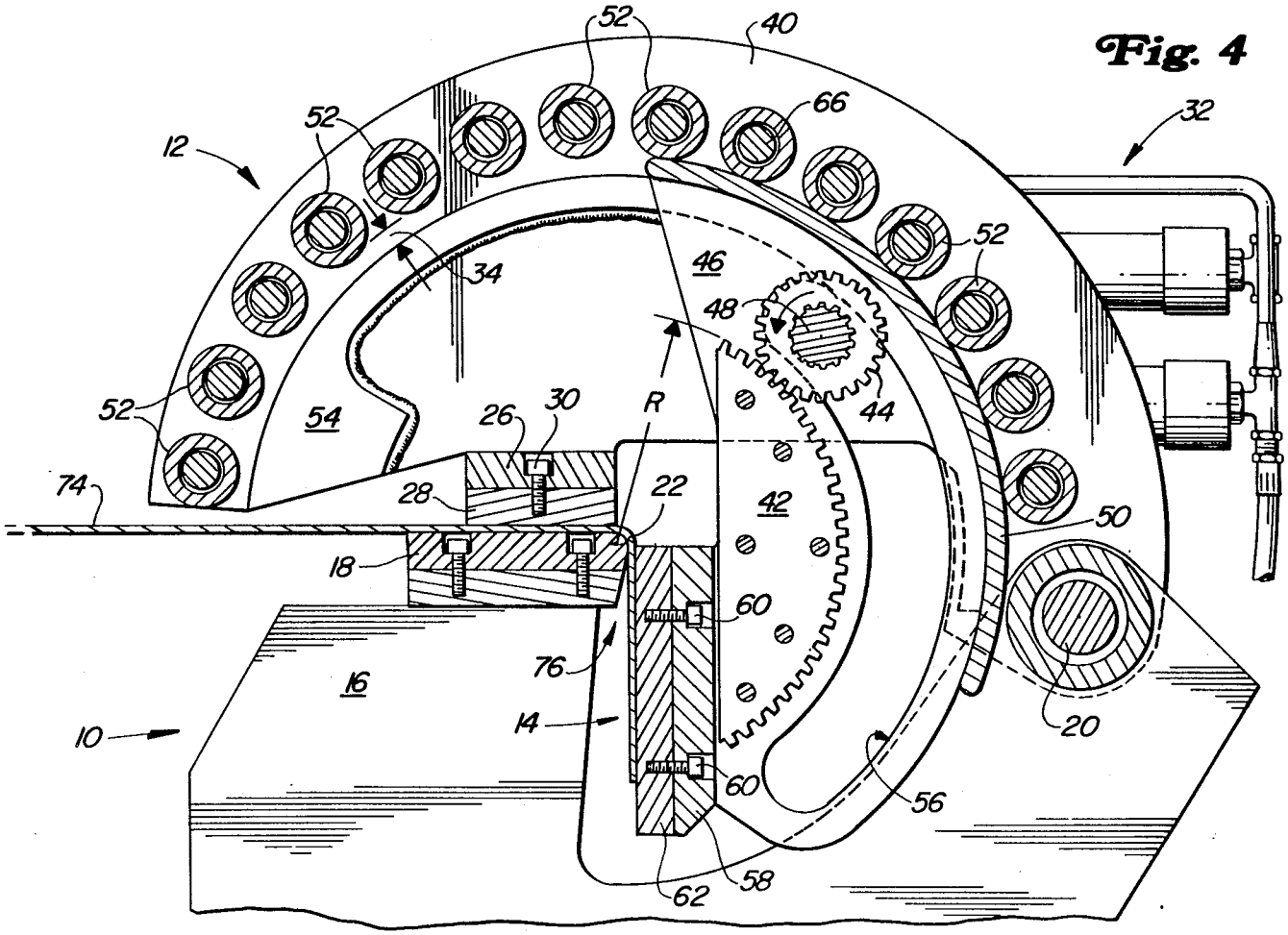
FIG. 4 is a sectional side view of the present invention taken along a vertical plane illustrating the invention in its metal bending configuration.

Looking now to FIGS. 2, 3, 4 and particularly 6, it will be seen that the invention is comprised of a material support 10, a clamping structure 12 and a bending structure 14.

The material supporting member 10 includes a support base 16 in the general shape of an anvil with a plate 18 upon which metal or other material is positioned. This structure is particularly well shown in FIG. 2.

The clamping structure 12 is comprised of a semi-circular housing pivotally mounted to the support 16 and offset from the support plate 18. The clamping structure 12 is adapted to swing about a shaft 20 having an axis generally parallel to the edge 22 of the plate 18. It is moved about the shaft 20 by a hydraulic rack and pinion rotary actuator designated 24.

The clamping structure 12 includes a two-part housing upon which is fixed as by welding or otherwise clamping plate supports 26. These supports 26 in turn carry the clamping plate 28, which in the preferred embodiment is removably attached by screws 30. As illustrated by the comparison of FIGS. 2 and 3, rotation of the clamping structure 12 about its pivot shaft 20 provides for clamping of the material between the support plate or first clamping surface 18 and the clamping plate or second clamping surface 28.

The invention is further comprised of a metal bending structure 14 which in the preferred form of the embodiment is carried by the clamping structure 12 for movement therewith. The bending structure 14 is powered by a hydraulic rotary actuator 32 to follow an arcuately-shaped guide track 34 provided in the clamping structure 12. FIGS. 3 and 4 best illustrate the range of movement of the bending structure 14 relative to the clamping structure 12.

Now directing attention to FIGS. 4, 5 and 6, the specific components of the preferred form of the invention will be discussed.

The support base 10 upon which metal is positioned for bending includes the anvil-shaped support structure 16 upon which lower or first clamping plates 18 are mounted. These clamping plates 18 are generally elongated in form as illustrated in the application depicted in FIG. 1 so as to support metal of a substantial length. The lower clamping plates 18 are further provided with an elongated and rounded edge 22 about which the metal is bent. The rounded edge is well illustrated in FIG. 4.

Carried at the right-hand side of the anvil-shaped support base 16 is an opening through which the shaft 20 is carried for supporting the clamping structure 12. The shaft 20 is fixed through a spline arrangement to the housing of the clamping structure 12 as shown in FIG. 6. The shaft 20 is driven by a pinion designated 36 which in turn is rotated by a hydraulically powered rotary actuator designated 38. As illustrated in Figs. 2 and 3, this shaft 20 rotates the clamping structure 12 between its alternate positions of metal clamping and release.

While the preferred form of the embodiment provides for the clamping structure 12 to rotate about shaft 20, it could also be adapted to move linearly or otherwise into and out of a metal clamping position.

The clamping structure 12 is comprised of a housing or carriage including left-and right-hand side frame members 40 in the form of semi-circular plates. See FIG. 6. These side frame members 40 carry at their outer end upper clamping plates 28 which are secured to plate supports 26 by screws 30 or similar means.

While not necessarily required by the invention, the bending components in the preferred form are carried by the clamping structure 12. These components include a rack 42 and pinion 44 mounted for movement along the track 34 provided in the clamping structure 12. The rack or gear segment 42 is carried between left- and right-hand rack and guide plate supports designated 46.

The pinion 44 is engageably mated with the rack 42 and is carried on a drive shaft 48 which in turn is supported between the left- and right-hand frames 40 of the clamping structure 12. This drive shaft 48 in turn carries pinion 44 which is driven by a hydraulic rotary actuator 32 supported on the side frame 40.

The guide plate supports 46 further carry a guide plate 50 in the form of a semi-circular shoe or bar. This guide plate 50 is carried in the track 34 provided in the clamping mechanism 12. The track 34 is composed on one side by a series of rollers 52 which are mounted between the opposite left- and right-hand side frames 40. Comprising the lower surface of the track 34 are a pair of slide surfaces 54, each being respectively welded to one side frame 40. Accordingly, it is in the space between these slide surfaces 54 and the lower surfaces of the rollers 52 that the semi-circular shoe 50 will move as the rotary actuator powers the pinion 44 and rack 42 to shift the bending structure 14. Also provided in each guide plate support 46 is a slotted opening 56 through which the drive shaft 48 passes as the gear segment or rack 42 moves between its alternate positions illustrated in FIGS. 3 and 4.

To the lower surface of the guide plate supports 46 is mounted a base 58 attached by welding or similar means. Removably attached to it by screws 60 in the preferred form of the embodiment is the bending plate or surface 62.

Joining the top surfaces of the left- and right-hand side frames 40 is a detachably secured cover 64 which prevents contaminants from easily entering the mechanism and allows quick access to the components for maintenance and/or repair.

Figure 5:
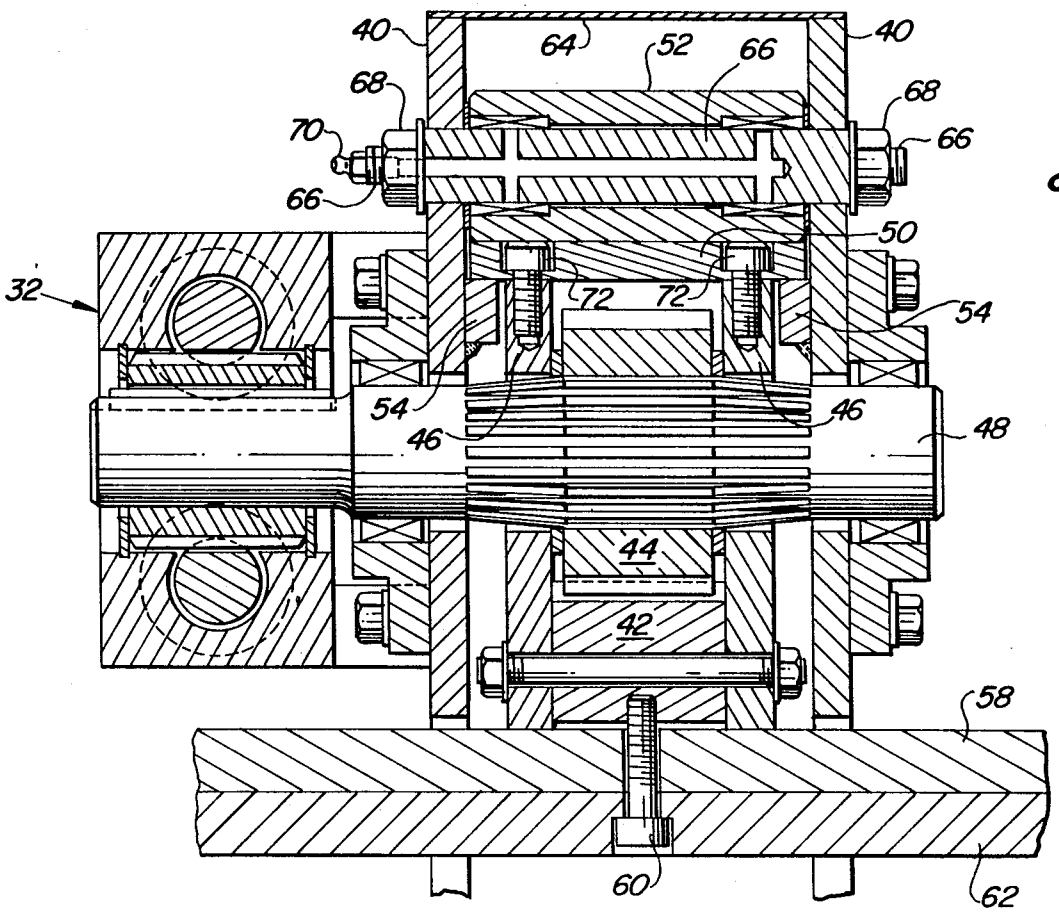
FIG. 5 is a view of the present invention taken along the lines 5—5 depicted in FIG. 3.
Figure 6:
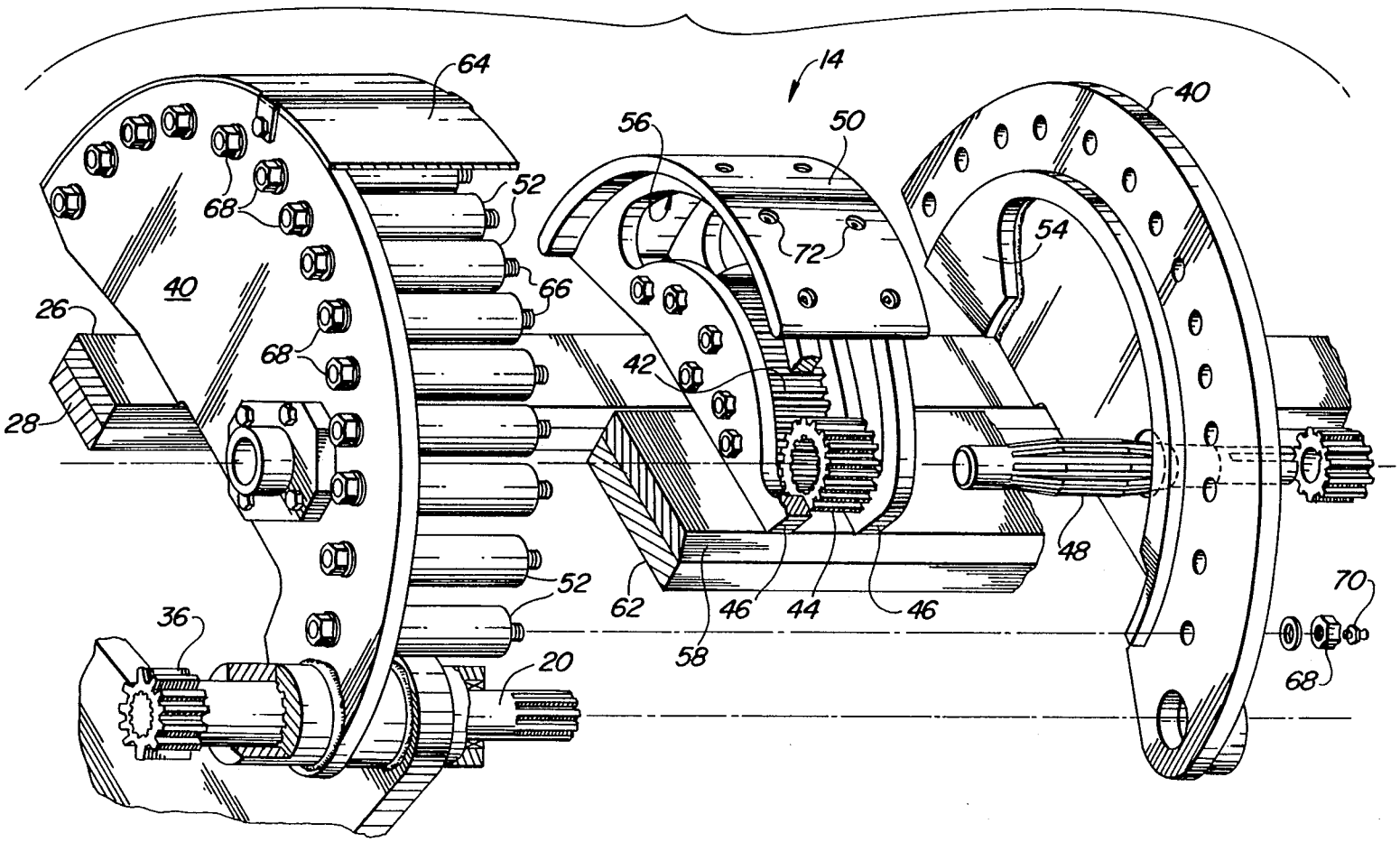
FIG. 6 is an exploded view of the components comprising the metal clamping and bending structure of the present invention, with the rotary actuators omitted.

Looking now to FIG. 5 which is a cross-sectional view taken along line 5—5 of FIG. 3 there is illustrated the interrelationship of the bending components and the clamping structure. At the top portion of the drawing, the cover 64 connects the left- and right-hand side frames 40 slightly above the roller cylinders 52. These cylinders 52 are carried by bolts 66 interconnected with nuts 68, each roller being provided with a lubrication fitting 70. The guide plate 50, which is connected to guide plate supports 46 by bolts 72 in the preferred form of the embodiment, contacts the rollers 52 along their lower surface and the guide plate slide surfaces 54 on their upper surfaces. The pinion 44 for driving the rack 42 between its positions illustrated in FIGS. 2 and 3 is driven by a conventional rotary actuator 32. On such actuator which has been found to be acceptable is a Parker Hydra-Power Rack and Pinion Actuator TR Series.

To review the operation of the invention, we start by looking at FIGS. 2, 3 and 4. Initially the operator will position a sheet of metal 74 or other material to be fabricated to a desired configuration upon the support base 10 and first clamping surface 18. The portion to be bent will extend beyond the lower clamping plate 18. Next the clamping structure 12 will be activated to rotate about its shaft 20 into the clamping position illustrated in FIG. 3. While the preferred form of the embodiment utilizes automated controls to actuate the clamping structure 12 and sequentially the bending structure 14, manual controls or overrides can be provided for the operator to actuate the steps of clamping the metal and then bending it.

The bending step follows clamping and is initiated by actuating the bending rotary actuator 32. As it is powered, the shaft 48 is rotated to drive the pinion 44 and rack 42 and accordingly move the bending structure 14 along the track 34.

As the rack or gear segment 42 is moved, the guide plate 50 will follow the track 34 between the rollers 52 and the slide surfaces 54 carried on each clamping side frame 40. Since many materials to be fabricated to a particular configuration have spring-back characteristics, provision is made in the lower clamping plate 16 for over-bending. This provision takes the form of an undercut 76 in the lower clamping plate 18 whereby the material can be bent to an angle in excess of that desired, thereby allowing for the metal to "spring back" to the desired angle.

In the preferred form of the embodiment, the bending plate 62 is rotated essentially about a constant radius centered at the elongated edge 22 of the lower clamping plate 18. This radius is designated R. Accordingly and as illustrated in FIG. 4, the teeth of the gear segment or rack 42 would rotate along an arc having a radius fixed at this edge 22.

Figure 1:
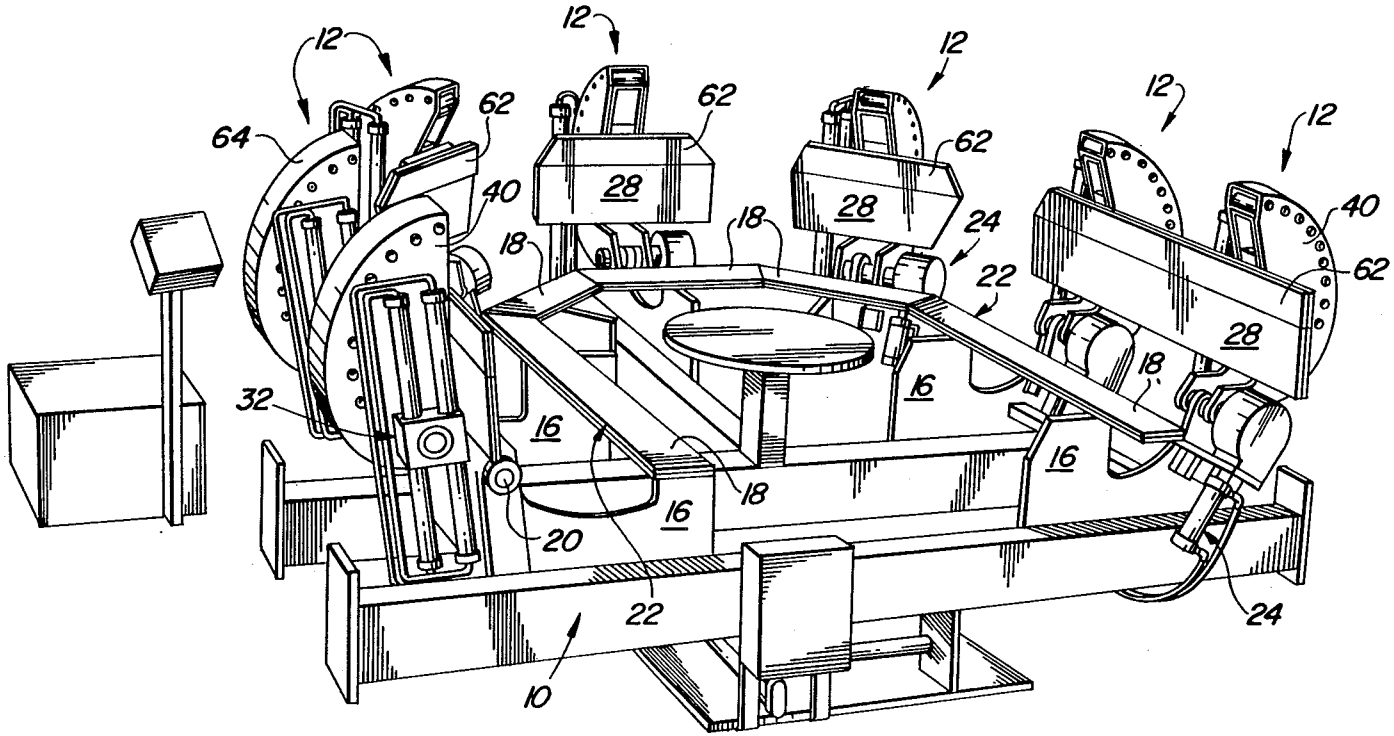
FIG. 1 is an elevated side and front perspective of a metal fabricating station utilizing several metal bending units, each of which employ the present invention.

While the preferred form of the invention is illustrated as a single metal bending unit, several units can be combined in a work station to bend several edges of a sheet as desired. Specifically illustrated in FIG. 1 is a work station utilizing the invention to bend five separate adjacent surfaces of a metal sheet. This particular work station is designed for fabricating the housing of a rotary mower structure.

While two clamping and bending units are utilized along the side portions of the work station to provide a more positive clamping and bending force along the length of the metal to be fabricated, any number of clamping or bending units could be provided along the material length.

While not specifically illustrated, the five separate bending stations of this application are carried on tracks providing for linear movement toward and away from the center of the station, thereby permitting the use of the station for fabricating housings of different sizes.

With the present invention, metal or similar materials can be quickly and easily bent to a desired configuration with significantly less force than has traditionally been required in the hydraulic press bending procedure which can be of particular use in a high volume fabrication operation.

We claim:

1. Mechanism for bending material including:

a material supporting member having a first clamping surface with an elongated edge;

clamping means carried on the supporting member and horizontally spaced from the first clamping surface, including a second clamping surface, adapted for swinging movement towards and away from the first clamping surface;

a bending means including a bending surface carried by said clamping means and swingably movable therewith, moveable through an arc relative to the edge of the first clamping surface to bend said material about said edge;

whereby the material can be clamped between the first and second clamping surfaces when the clamping means is moved towards the first surface and is subsequently bent by the bending surface as it is moved through an arc.

2. The invention defined in claim 1 wherein the elongated edge is rounded and the material is bent about that edge.

3. The invention defined in claim 1 wherein the bending means, while moving through its arc, is rotated about a radius approximately centered at the edge of the first clamping surface.

4. The invention defined in claim 1 wherein the clamping and bending surfaces are selectively removable so as to permit substitution of other surfaces.

5. The invention defined in claim 1 wherein the clamping means is adapted for swinging movement about an axis spaced from and generally parallel to the edge of the clamping surface and the material is clamped between the first and second clamping surfaces as the clamping means is swung towards the first surface.

6. The invention defined in claim 5 wherein the clamping means is swung about its axis by a rack and pinion rotary actuator.

7. The invention defined in claim 5 wherein the material, when clamped between the first and second clamping surfaces, has its portion to be bent projecting over the elongated edge of the first surface and is positioned between the first clamping surface and the axis of swinging movement of the clamping means.

8. The invention defined in claim 5 wherein the bending means is carried by the clamping means for swinging movement therewith.

9. The invention defined in claim 1 wherein the bending means is carried by the clamping means for arcuate movement therealong.

10. The invention defined in claim 9 wherein the bending means is moved along its generally circular arc by a rack and pinion rotary actuator.

11. The invention defined in claim 10 wherein the bending surface is rigid with and adapted to move with the rack.

12. The invention defined in claim 9 wherein the clamping means carries a generally arcuately-shaped guide track and the bending means is adapted for movement along that track.

13. The invention defined in claim 12 wherein the guide track is formed between a slide surface and a series of rollers and the bending means includes a member moveable between the slide surface and rollers.

14. Mechanism for bending material comprising:

a supporting member having a first clamping surface with an elongated edge;

clamping means including a second clamping surface adapted to move towards and away from the first surface as it swingably moves about an axis spaced from and generally parallel to the edge of the first clamping surface;

bending means carried by the clamping means and swingably movable therewith, including a bending surface adapted to move along a generally arcuately shaped track of the clamping means and swing radially about the edge of the first surface to bend said material about said edge;

whereby material placed on the first clamping surface can first be secured between it and the second clamping surface as the second surface is moved towards the first and then bent as the bending surface moves along the track of the clamping means.

15. The invention defined in claim 14 wherein rack and pinion actuators swingably move the second clamping and bending surfaces.

16. The invention defined in claim 14 wherein the bending surface swings about a radius having its center generally located along the elongated edge.

17. The invention defined in claim 14 wherein the clamping means track is composed of a slide surface spaced apart from a series of rollers with the bending surface being attached to a track member moveable along said track.

18. Mechanism for bending material including:

a material support having an elongated edge;

clamping means adapted to secure material between it and the support with a portion of said material projecting beyond the edge of said support;

the clamping means being supported to swing about an axis spaced from the support between a first position away from said support and a second position in material clamping relationship with said support, said clamping means including:

a housing, a guide track carried in the housing, said track being radially spaced from the edge of the support when the clamping means is in its second position, bending means carried in said track for back and forth movement, a powered rack and pinion means, and a bending plate carried by the rack and pinion means for engaging material which projects beyond the support edge when the clamping means is in its second position and for bending the material about the edge of the support as the rack and pinion means is moved along the guide track.

19. Mechanism for bending material including:

a base having a first material clamping plate supported thereon with an elongated edge;

a clamping means pivotally supported to selectively swing towards and away from the first plate;

a second clamping plate carried by the clamping means to register with the first clamping plate as the clamping means is swung towards the first plate;

an arcuate track carried by the clamping means generally radially spaced from the elongated edge when the clamping means is in register with the first plate, said track formed by a slide surface and a series of rollers spaced from the slide surface;

a carriage moveable by the rack and pinion means between a first and second position along said track;

a bending plate mounted on said carriage and adapted to swing an arc centered generally at the edge of the first plate as the carriage is moved to one of its two positions;

whereby metal placed upon the clamping plate and extending over the edge is clamped between the first and second clamping plates as the clamping means is swung into registry with the first plate and then is bent as the bending plate is swung through its arc centered at the edge of the first plate.

20. Mechanism for bending material including:

a material supporting member having a first clamping surface with an elongated edge;

clamping means including a second clamping surface adapted for swinging movement about an axis which is spaced from and generally parallel to the edge of the first clamping surface; and a bending means carried by said clamping means and swingably movable therewith including a bending surface moveable through an arc relative to the edge of the first clamping surface to bend said material about said edge, whereby the material can be clamped between the first and second clamping surfaces when the clamping means is swung towards the first surface and is then bent by the bending surface as it is moved through an arc.

21. The invention defined in claim 20 wherein the elongated edge is rounded and the material is bent about that edge.

22. The invention defined in claim 20 wherein the bending means, while moving through its arc, is rotated about a radius approximately centered at the edge of the first clamping surface.

23. The invention defined in claim 20 wherein the clamping and bending surfaces are selectively removable so as to permit substitution of other surfaces.

24. The invention defined in claim 20 wherein the clamping means is swung about its axis by a rack and pinion rotary actuator.

25. The invention defined in claim 20 wherein the material, when clamped between the first and second clamping surfaces, has its portion to be bent projecting over the elongated edge of the first surface and positioned between the first clamping surface and the axis of swinging movement of the clamping means.

26. The invention defined in claim 20 wherein the bending means is carried by the clamping means for swinging movement therewith.

27. The invention defined in claim 20 wherein the bending means is carried by the clamping means for arcuate movement therealong.

28. The invention defined in claim 20 wherein the bending means is moved along its generally circular arc by a rack and pinion rotary actuator.

29. The invention defined in claim 28 wherein the bending surface is rigid with and adapted to move with the rack.

30. Mechanism for bending material including:

a material supporting member having a first clamping surface with an elongated edge;

clamping means including a second clamping surface adapted for movement towards and away from the first clamping surface and having a curved guide track; and a bending means carried by the clamping means for movement both wiht said clamping means and along said track, said bending means including a bending surface carried for shiftable movement between the track and edge to traversean arc relative to the edge of the first clamping surface and bend said material about said edge.

whereby material can be clamped between the first and second clamping surfaces when the clamping means is moved towards the first surface and bent by the bending surface as it is moved through an arc along said track.

31. The invention defined in claim 30 wherein the elongated edge is rounded and the material is bent about the edge.

32. The invention defined in claim 30 wherein the bending means, while moving through its arc, is moved along a path having a radius approximately centered at the edge of the first clamping surface.

33. The invention defined in claim 30 wherein the clamping and bending surfaces are selectively removable so as to permit substitution of other surfaces.

34. The invention defined in claim 27 wherein the clamping means is swung about its axis by a rack and pinion rotary actuator.

35. The invention defined in claim 27 wherein the material, when clamped between the first and second clamping surfaces, the its portion to be bent projecting over the elongated edge of the first surface and is positioned between the first clamping surface and the axis of swinging movement of the clamping means.

36. The invention defined in claim 27 wherein the bending means is carried by the clamping means for swinging movement therewith.

37. The invention defined in claim 30 wherein the bending means is moved along its generally circular arc by a rack and pinion rotary actuator.

38. The invention defined in claim 37 wherein the bending surface is rigid with and adapted to move with the rack.

39. The invention defined in claim 30 wherein the guide track includes a slide surface spaced from a series of rollers and the bending means includes a member moveable between the slide surface and rollers.

40. The invention defined in claim 30 wherein the clamping means is carried by the supporting member for swinging movement about an axis horizontally spaced from the elongated edge.

41. The invention defined in claim 30 wherein the clamping surface is first swingably moved into contact with material placed on the first clamping surface and then the bending means is moved through an arcuate path as it follows the curved guide track.

42. The invention defined in claim 31 wherein the bending means includes a rack mounted to move along the curved path of the guide track and the rack carries the bending surface.

43. The invention defined in claim 30 wherein a pair of spaced apart guide tracks are provided in the clamping means with a series of rollers defining the path of the track.

* * * * *